US008622207B2

(12) United States Patent
Smalley

(10) Patent No.: US 8,622,207 B2
(45) Date of Patent: Jan. 7, 2014

(54) CARRIER FOR CONTAINERS

(75) Inventor: Brian Smalley, Bristol (GB)

(73) Assignee: Graphic Packaging International, Inc., Marietta, GA (US)

( * ) Notice: Subject to any disclaimer, the term of this patent is extended or adjusted under 35 U.S.C. 154(b) by 210 days.

(21) Appl. No.: 12/566,120

(22) Filed: Sep. 24, 2009

(65) Prior Publication Data

US 2010/0072086 A1 Mar. 25, 2010

Related U.S. Application Data

(60) Provisional application No. 61/194,070, filed on Sep. 24, 2008.

(51) Int. Cl.
*B65D 71/00* (2006.01)

(52) U.S. Cl.
USPC ..... 206/162; 206/175; 206/193; 229/117.14

(58) Field of Classification Search
USPC ..... 206/428–430, 434, 427, 141–142, 147, 206/175, 200, 162, 193; 229/117.14, 229/120.14
See application file for complete search history.

(56) References Cited

U.S. PATENT DOCUMENTS

| | | | | |
|---|---|---|---|---|
| 2,225,822 A | | 12/1940 | Crook | |
| 2,227,330 A | | 12/1940 | Turner | |
| 2,324,771 A | * | 7/1943 | Fiore | 206/189 |
| 2,331,312 A | | 10/1943 | Dorfman | |
| 2,336,857 A | | 12/1943 | Gies et al. | |
| 2,446,161 A | * | 7/1948 | Price | 206/172 |
| 2,689,061 A | | 9/1954 | Gray | |
| 2,783,916 A | | 3/1957 | Hodapp | |
| 3,053,411 A | | 9/1962 | Struble et al. | |
| 3,190,487 A | | 6/1965 | Wood | |
| 3,191,800 A | | 6/1965 | Kowal | |
| 3,229,849 A | | 1/1966 | Spillson | |
| 3,236,414 A | | 2/1966 | Slevin, Jr. | |

(Continued)

FOREIGN PATENT DOCUMENTS

| | | |
|---|---|---|
| CA | 2 216 515 | 8/1997 |
| DE | 9004439 U1 | 6/1990 |

(Continued)

OTHER PUBLICATIONS

PCT Search Report and Written Opinion for related PCT Application No. PCT/US2009/058178, bearing international filing date of Sep. 24, 2009.

(Continued)

*Primary Examiner* — David T Fidei
*Assistant Examiner* — Robert Poon
(74) *Attorney, Agent, or Firm* — Womble Carlyle Sandridge & Rice, LLP

(57) ABSTRACT

A carrier for holding a plurality of containers. The carrier has at least one bottom panel, at least one top panel, a front panel, a back panel, and at least two side panels. The at least one top panel is foldably connected to one of the front panel and the back panel. The at least one top panel has a handle portion for forming a handle of the carrier and a retaining portion having container receiving openings for retaining the containers in the carrier. The carrier has a retention flap foldably connected to the top panel for retaining the carrier in an assembled position.

30 Claims, 9 Drawing Sheets

(56) References Cited

U.S. PATENT DOCUMENTS

| | | | | | |
|---|---|---|---|---|---|
| 3,669,306 | A | | 6/1972 | Forrer | |
| 3,744,704 | A | | 7/1973 | Struble | |
| 3,917,061 | A | | 11/1975 | Stout | |
| 4,155,502 | A | | 5/1979 | Forte | |
| 4,171,046 | A | | 10/1979 | Bonczyk | |
| 4,205,748 | A | | 6/1980 | Wilson | |
| 4,234,114 | A | | 11/1980 | Wood | |
| 4,243,138 | A | | 1/1981 | Wilson | |
| 4,284,195 | A | | 8/1981 | Champlin | |
| 4,308,950 | A | | 1/1982 | Wood | |
| 4,326,628 | A | | 4/1982 | Wood | |
| 4,362,240 | A | | 12/1982 | Elward | |
| 4,374,561 | A | | 2/1983 | Stout et al. | |
| 4,413,729 | A | | 11/1983 | Wood | |
| 4,450,956 | A | | 5/1984 | Wood | |
| 4,480,746 | A | | 11/1984 | Wood | |
| 4,722,437 | A | | 2/1988 | Walsh | |
| 4,792,038 | A | | 12/1988 | Cooper | |
| 4,927,009 | A | | 5/1990 | Stout | |
| 5,040,672 | A | | 8/1991 | DeMaio et al. | |
| 5,392,984 | A | * | 2/1995 | Yocum | 229/117.15 |
| 5,458,234 | A | | 10/1995 | Harris | |
| 5,484,053 | A | | 1/1996 | Harris | |
| 5,499,712 | A | | 3/1996 | Harrelson | |
| 5,531,319 | A | | 7/1996 | Harrelson | |
| 5,538,130 | A | | 7/1996 | Harrelson | |
| 5,538,131 | A | | 7/1996 | Harrelson | |
| 5,590,762 | A | | 1/1997 | Harrelson | |
| 5,593,027 | A | | 1/1997 | Sutherland | |
| 5,595,291 | A | * | 1/1997 | Negelen | 206/143 |
| 5,624,024 | A | * | 4/1997 | Miess | 206/172 |
| 5,649,620 | A | | 7/1997 | Harrelson | |
| 5,657,864 | A | | 8/1997 | Harrelson | |
| 5,657,865 | A | | 8/1997 | Harrelson | |
| 5,682,982 | A | | 11/1997 | Stonehouse | |
| 5,695,051 | A | | 12/1997 | Hart | |
| 5,775,487 | A | | 7/1998 | Harrelson | |
| 5,803,264 | A | | 9/1998 | Gersten et al. | |
| 5,871,090 | A | | 2/1999 | Doucette et al. | |
| 5,878,877 | A | | 3/1999 | Sutherland | |
| 5,947,273 | A | | 9/1999 | Dalrymple et al. | |
| 6,131,729 | A | | 10/2000 | Eckermann et al. | |
| 6,155,962 | A | | 12/2000 | Dalrymple et al. | |
| 6,230,882 | B1 | * | 5/2001 | Wischusen, III | 206/194 |
| 6,341,689 | B1 | | 1/2002 | Jones | |
| 6,371,287 | B1 | | 4/2002 | Jones et al. | |
| 6,598,739 | B1 | * | 7/2003 | Collura | 206/185 |
| 6,736,260 | B2 | | 5/2004 | Gomes et al. | |
| 6,938,756 | B2 | | 9/2005 | Schuster | |
| 7,011,209 | B2 | * | 3/2006 | Sutherland et al. | 206/175 |
| 7,134,547 | B2 | * | 11/2006 | Auclair | 206/143 |
| 7,185,758 | B2 | | 3/2007 | Cuomo | |
| 7,243,785 | B2 | | 7/2007 | Cuomo | |
| 7,267,224 | B2 | | 9/2007 | Cuomo | |
| 7,357,247 | B2 | | 4/2008 | Guenther | |
| 7,370,755 | B2 | | 5/2008 | Cuomo | |
| 7,374,038 | B2 | | 5/2008 | Smalley | |
| 7,604,115 | B2 | | 10/2009 | Cuomo | |
| 8,091,702 | B1 | | 1/2012 | Keip | |
| 2003/0111363 | A1 | | 6/2003 | Theelen | |
| 2003/0159950 | A1 | * | 8/2003 | Jones et al. | 206/163 |
| 2003/0213705 | A1 | | 11/2003 | Woog | |
| 2004/0094435 | A1 | * | 5/2004 | Auclair et al. | 206/168 |
| 2005/0103651 | A1 | * | 5/2005 | Lebras | 206/162 |
| 2005/0230273 | A1 | | 10/2005 | Kohler | |
| 2007/0029212 | A1 | * | 2/2007 | Smalley | 206/175 |
| 2009/0008273 | A1 | | 1/2009 | Smalley | |

FOREIGN PATENT DOCUMENTS

| | | | |
|---|---|---|---|
| EP | 1 319 607 | A1 | 6/2003 |
| WO | WO 97/05026 | | 2/1997 |
| WO | WO 98/19932 | A1 | 5/1998 |
| WO | WO 2005/044687 | A1 | 5/2005 |

OTHER PUBLICATIONS

Supplementary European Search Report for EP 09 81 6839 dated Jan. 6, 2012.

Canadian Office Action for Application No. 2,737,581, dated Dec. 14, 2011.

* cited by examiner

CARRIER FOR CONTAINERS

CROSS-REFERENCE TO RELATED APPLICATION

This application claims the benefit of U.S. Provisional Application No. 61/194,070, filed Sep. 24, 2008.

INCORPORATION BY REFERENCE

The entire disclosure of U.S. Patent Application No. 61/194,070, filed Sep. 24, 2008 is incorporated herein in its entirety by this reference.

BACKGROUND OF THE DISCLOSURE

The present disclosure generally relates to carriers or cartons for holding and displaying containers. More specifically, the present disclosure relates to basket-style carriers.

SUMMARY OF THE DISCLOSURE

In general, one aspect of the disclosure is directed to a carrier for holding a plurality of containers. The carrier comprises panels that extend at least partially around an interior of the carrier. The panels comprise at least one bottom panel, at least one top panel, a front panel, a back panel, and at least two side panels. The at least one top panel is foldably connected to one of the front panel and the back panel. The at least one top panel has a handle portion for forming a handle of the carrier and a retaining portion having container receiving openings for receiving the containers in the carrier. The carrier includes a retention flap foldably connected to the top panel for retaining the carrier in an assembled position.

In another aspect, the disclosure is generally directed to a carrier for holding a plurality of containers. The carrier comprises panels that extend at least partially around an interior of the carrier. The panels comprise a front panel, a back panel, a first side panel foldably connected to at least one of the front panel and the back panel, a second side panel foldably connected to at least one of the front panel and the back panel, at least one top panel, and at least one bottom panel. The at least one top panel is foldably connected to one of the front panel and the back panel. The at least one top panel comprises a handle portion for forming a handle of the carrier and a retaining portion having container receiving openings for receiving the containers in the carrier. The at least one top panel comprises a retention flap foldably connected to the top panel and positioned between at least two of the containers for retaining the carrier in an assembled position.

In another aspect, the disclosure is generally directed to a blank for forming a carrier for holding a plurality of containers. The blank comprises panels that comprise a front panel, a back panel, a first side panel foldably connected to at least one of the front panel and the back panel, a second side panel foldably connected to at least one of the front panel and the back panel, at least one top panel, and at least one bottom panel. The at least one top panel is foldably connected to one of the front panel and the back panel. The at least one top panel comprises handle features for forming a handle of the carrier formed from the blank and a retaining portion having container receiving openings The at least one top panel comprises a retention flap foldably connected to the top panel and adjacent one of the container receiving openings.

In another aspect, the disclosure is generally directed to a method of forming a carrier for containing a plurality of containers. The method comprises obtaining a blank having panels that comprise a front panel, a back panel, a first side panel foldably connected to at least one of the front panel and the back panel, a second side panel foldably connected to at least one of the front panel and the back panel, at least one top panel, and at least one bottom panel, the at least one top panel is foldably connected to one of the front panel and the back panel, the at least one top panel comprises handle portion, a retaining portion having container receiving openings, and a retention flap foldably connected to the top panel and adjacent one of the container receiving openings. The method comprises forming the blank into an open-ended sleeve, and inserting containers into the sleeve such that the containers are inserted through the container receiving openings of the retaining portion. At least two of the containers are placed into contact with the retention flap to retain the carrier in an assembled position. The method comprises closing the open-ended sleeve to at least partially close the carrier.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure generally relates to carriers, packages, constructs, sleeves, cartons, or the like, for holding, carrying, and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present disclosure can accommodate containers of numerous different shapes. For the purpose of illustration and not for the purpose of limiting the scope of the disclosure, the following detailed description describes beverage containers (e.g., glass or plastic bottles) at least partially disposed within the carrier embodiments. In this specification, the terms "lower," "bottom," "upper," "top," "front," and "back" indicate orientations determined in relation to fully erected carriers.

Figure 1:
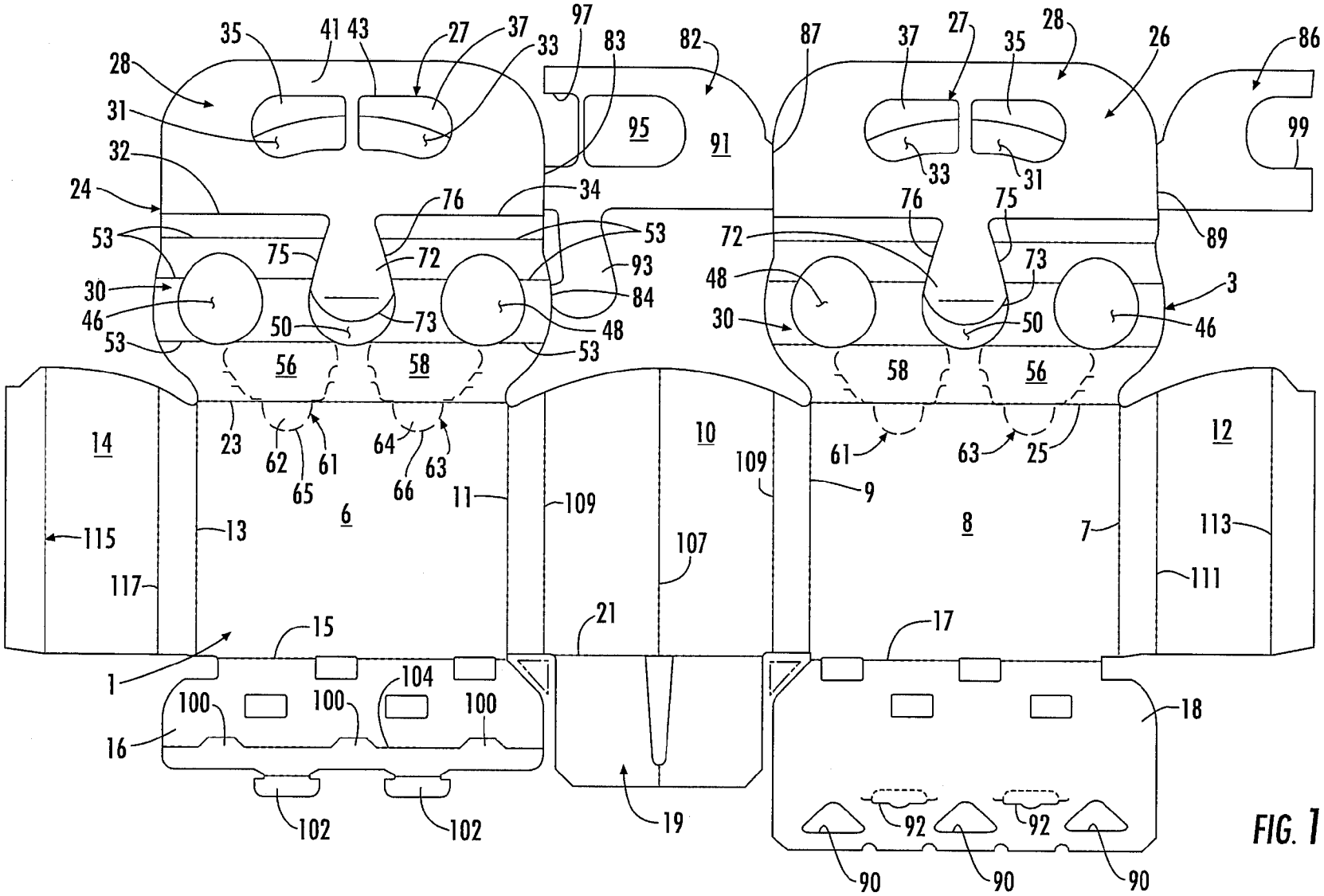
FIG. 1 is a plan view of an exterior surface of a blank used to form a carrier according to one embodiment of the disclosure.
Figure 2:
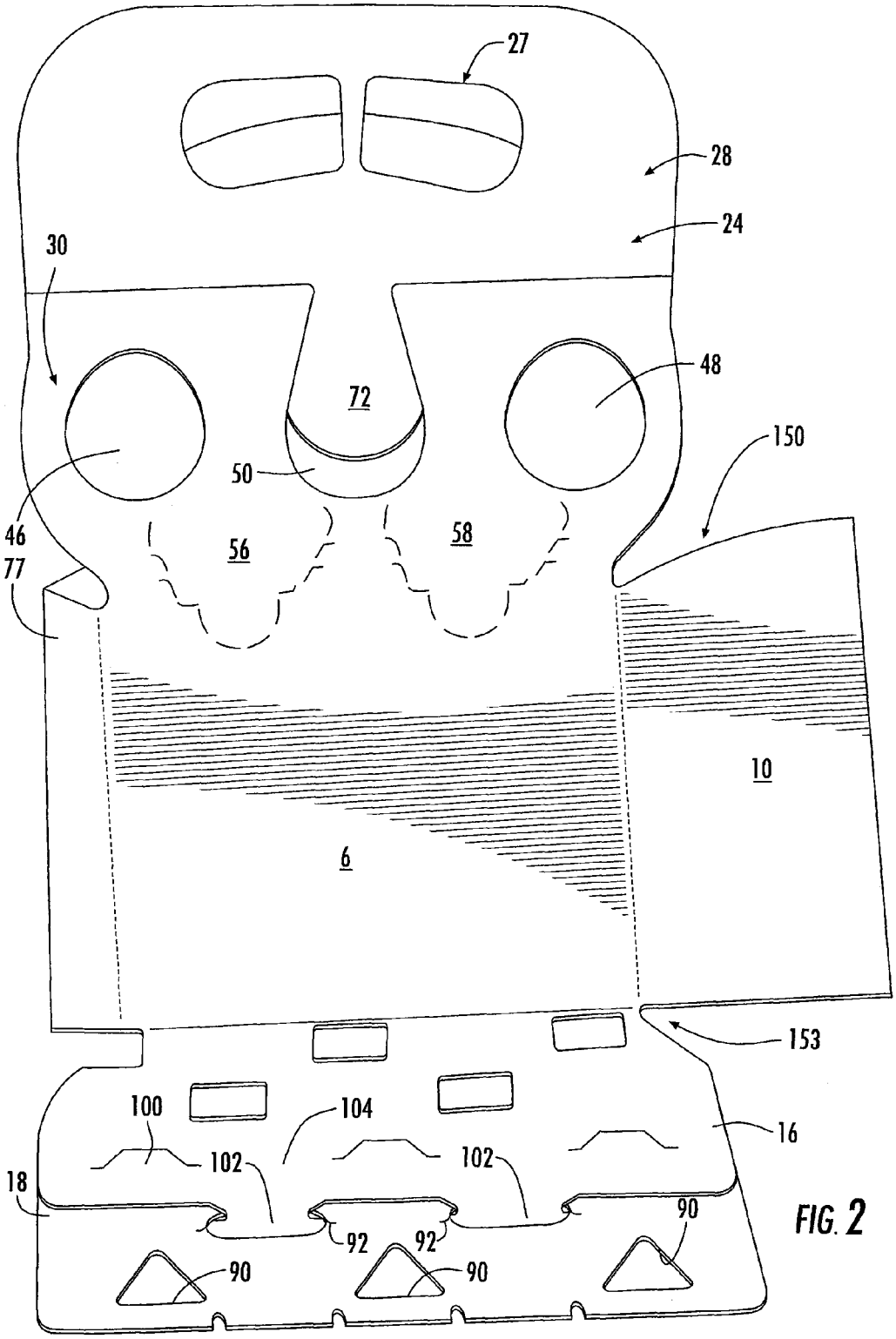
FIG. 2 is a plan view of one side of the blank of FIG. 1 partially assembled into the carrier.
Figure 5:
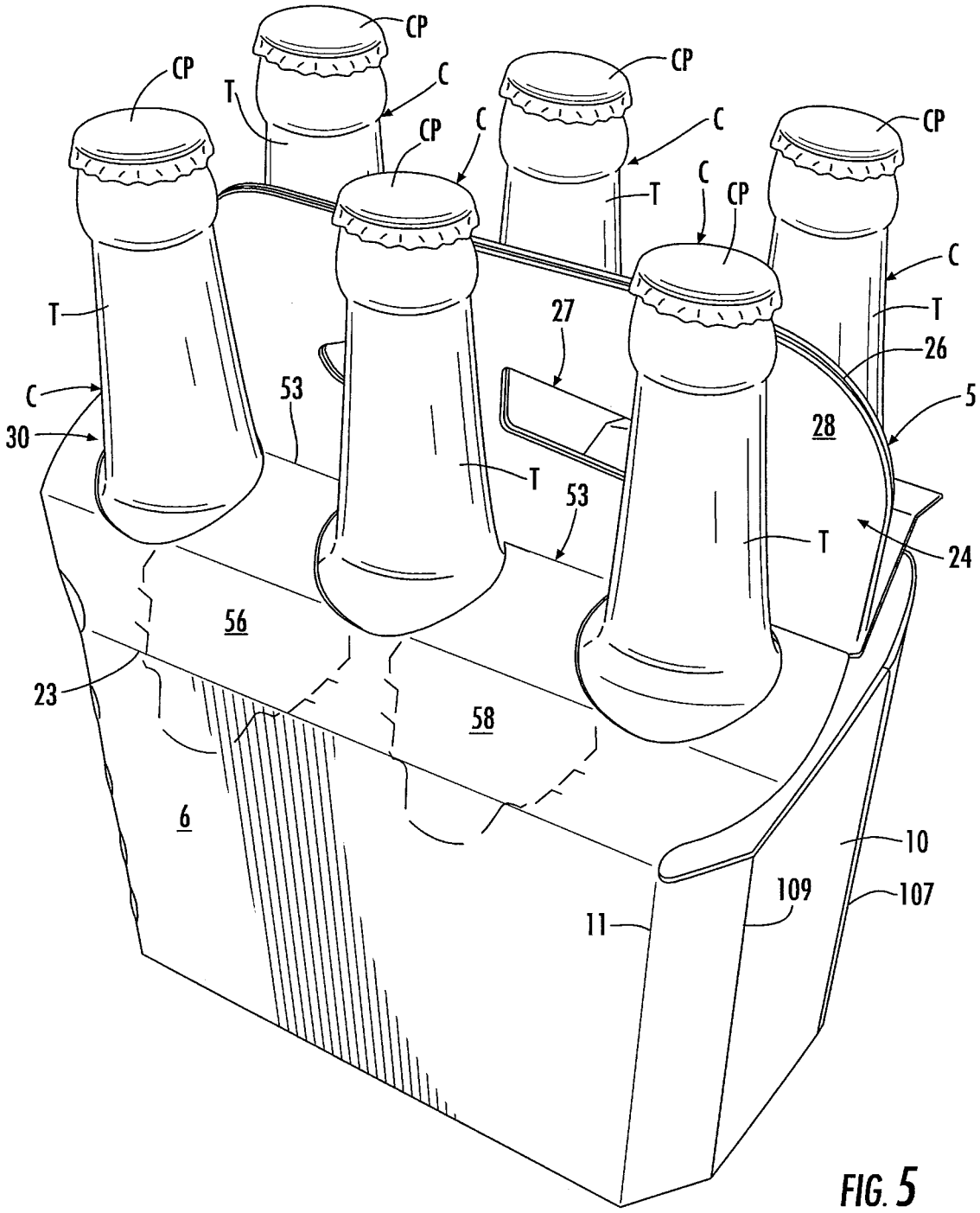
FIG. 5 is a perspective of the assembled and loaded carrier.

FIG. 1 is a plan view of an exterior side 1 of a blank 3 used to form a carton, package, or carrier 5, in accordance with an exemplary embodiment of the present disclosure. In the illustrated embodiment and as best understood with reference to FIGS. 6 and 8, the containers C are bottles having a wide bottom B and a narrow top T including a cap CP. As shown in FIG. 5, the carrier 5 is sized to contain six containers C. The carrier 5 may be sized and shaped to hold more or less than six containers C. Also, the carrier 5 may hold containers C of other shapes and sizes without departing from the disclosure.

The blank 3 has a longitudinal axis L1 and a lateral axis L2. The blank 3 has a front panel 6, a back panel 8, a first side panel 10, a second side panel 12, and a third side panel 14. A first bottom flap 16 is foldably connected to the front panel 6, a second bottom flap 18 is foldably connected to the back panel 8, and a third bottom panel 19 is foldably connected to the first side panel 10. A first top panel 24 is foldably connected to the front panel 6. A second top panel 26 is foldably connected to the back panel 8.

In the illustrated embodiment, the front panel 6 is respectively foldably connected to the first side panel 10 at a lateral fold line 11 and is foldably connected to the third side panel 14 at a lateral fold line 13. The front panel 6 is respectively foldably connected to the first bottom flap 16 at a longitudinal fold line 15 and is foldably connected to the first top panel 24 at a longitudinal fold line 23.

In the illustrated embodiment, the back panel 8 is respectively foldably connected to the first side panel 10 at a lateral fold line 9 and is foldably connected to the second side panel 12 at a lateral fold line 7. The back panel 8 is respectively foldably connected to the second bottom flap 18 at a longitudinal fold line 17 and is foldably connected to the second top panel 26 at a longitudinal fold line 25. The first side panel 10 is foldably connected to the third bottom end flap 19 at a longitudinal fold line 21.

In one embodiment, the first top panel 24 includes an upper portion (broadly "handle portion") 28 and a lower portion (broadly "retaining portion") 30 foldably connected to the upper portion at longitudinal fold lines 32, 34. The upper portion 28 comprises handle features 27 including respective handle openings 31, 33 and handle flaps 35, 37 foldably connected to the top panel 24 at respective longitudinal fold lines 41, 43.

Figure 6:
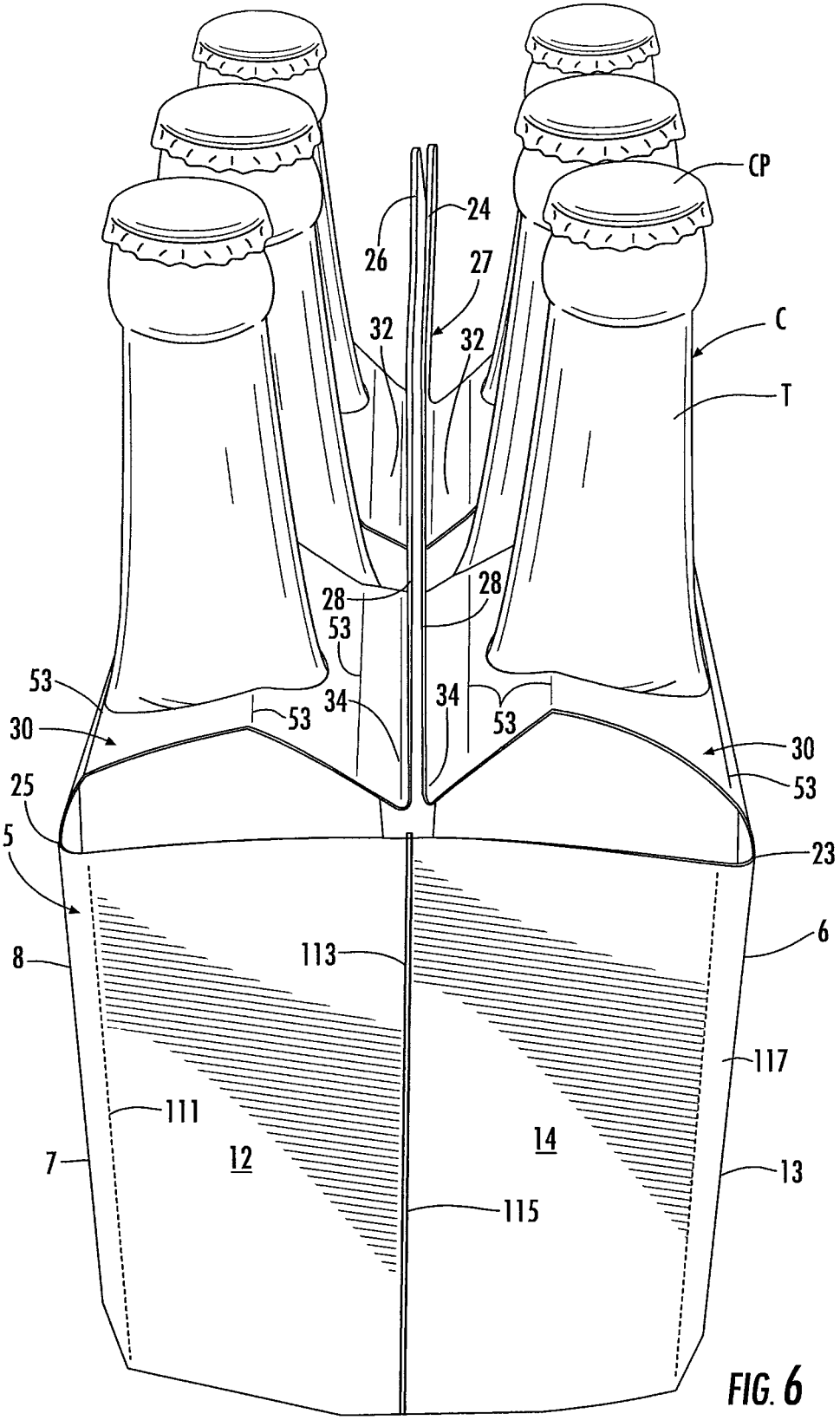
FIG. 6 is a side view of the assembled and loaded carrier.

As shown in FIG. 1, the lower portion 30 of the first top panel 24 includes two end openings 46, 48, adjacent respective lateral ends of the lower portion, and a middle opening 50 between the two end openings. The two end openings 46, 48 are generally circular-shaped and the middle opening 50 is generally crescent-shaped. In one embodiment, the lower portion 30 comprises longitudinal fold lines 53 for positioning the lower portion of the first top panel 24 relative to the top portion 28. In one embodiment, the longitudinal fold lines 53 allow portions of the lower portion 30 to be positioned as shown in FIG. 6 so that the lower portion is generally curved when the carrier 5 is assembled. The longitudinal fold lines 53 could be otherwise shaped, positioned, arranged, and/or omitted without departing from the disclosure.

In the illustrated embodiment, the lower portion 30 of the first top panel 24 includes two dispenser panels 56, 58 below the openings 46, 48, 50. The dispenser panels 56, 58 are respectively defined by a tear line 61, 63. The tear line 61 extends between the opening 46 and the middle opening 50 and includes a curved portion 65 that defines an actuation tab 62 in the front panel 6. The tear line 63 extends between the opening 48 and the middle opening 50 and includes a curved portion 66 that defines an actuation tab 64 in the front panel 6. The dispenser panels 56, 58 could be otherwise shaped, arranged, and/or positioned, or could be omitted, without departing from the scope of this disclosure. Further, the dispenser panels 56, 58 could be at least partially defined by a line or lines of weakening other than the tear lines 61, 63 (e.g., cut lines) without departing from the disclosure.

The first top panel 24 includes a retention flap 72 that is foldably connected to the upper portion 28 of the first top panel. In the illustrated embodiment, the retention flap 72 extends downwardly below the longitudinal fold lines 32, 34 and has a bottom curved edge 73 that is adjacent to and partially defines the middle opening 50 in the lower portion 30. The retention flap 72 is separated from the lower portion 30 of the top panel 24 by two cut lines 75, 76. The retention flap 72 could be otherwise shaped, arranged, and positioned, or could be omitted, without departing from this disclosure.

In the illustrated embodiment, the second top panel 26 is shaped similar to the first top panel 24 and includes identical features that are described above for the first top panel. In addition, the second top panel 26 includes a first reinforcement flap 82 foldably connected to the upper portion 28 of the second top panel 26 at a lateral fold line 87. The first reinforcement flap 82 is separated from the first top panel 24 by cut lines 83, 84. The second top panel 26 has a second reinforcement flap 86 foldably connected to the upper portion 28 of the second top panel 26 at a lateral fold line 89. In the illustrated embodiment, the first and second reinforcement flaps 82, 86 are shaped for overlaying the upper portion 28 of the second top panel 26 when the blank 3 is formed into the carrier 5. In the illustrated embodiment, the first reinforcement flap 82 has a central portion 91 that is foldably connected to the upper portion 28 of the second top panel 26 and a lowermost retention portion 93 that extends downward from the central portion. The central portion 91 has an opening 95 and a notch 97 at a free end of the first reinforcement flap 82. The second reinforcement flap 86 has a notch 99 at a free end thereof. The first reinforcement flap 82 and/or second reinforcement flap 86 could be otherwise shaped arranged, positioned, and/or omitted without departing from the scope of this disclosure. Further, the second top panel 26 could be otherwise shaped, arranged, positioned, and/or omitted without departing from the scope of this disclosure.

In the illustrated embodiment, the second bottom flap 18 includes cutouts forming primary female locking edges 90 that are shaped and positioned to engage primary male locking tab projections 100 on the first bottom flap 16. The second bottom end flap 18 includes slits 92 shaped and positioned to receive outer secondary locking tab projections 102 on the first bottom end flap 16. The first bottom end flap 16 includes a longitudinal fold line 104 which is interrupted by the slits that define the primary male locking tab projections 100. Although the locking elements of the blank 3 are illustrated to demonstrate one bottom panel/flap locking arrangement suitable for use with the carrier 5 (FIG. 5), it is understood that any alternative form of bottom panel/flap locking structure may be employed without departing from the disclosure. For example, the locking features (e.g., primary male locking tab projections 100, secondary male locking tab projections 102, primary female locking edges 90, slits 92, etc.) could be omitted and the bottom flaps 16, 18 could be held together with adhesive (e.g., glue) without departing from the disclosure. Further the blank 3 could include other bottom closure configurations.

In the illustrated embodiment, the first side panel 10 includes a lateral fold line 107 bisecting the first side panel, and two lateral fold lines 109 spaced from a respective lateral fold line 11, 9 of the blank 3. The second side panel 12 includes lateral fold lines 111, 113 and the third side panel 14 includes lateral fold lines 115, 117. The lateral fold lines 107, 109, 111, 113, 115, 117 in the side panels 10, 12, 14 allow the side panels to be positioned during formation of the blank 3 into the carrier 5, and allow the side panels to have respective portions that are angled at respective fold lines when the blank is assembled into the carrier. Alternatively, one or more of the side panels 10, 12, 14 could be free from fold lines such that the side panels are substantially planar when the carrier 5 is assembled, or the side panels could be otherwise shaped, arranged, and/or configured without departing from the disclosure.

Figure 3:
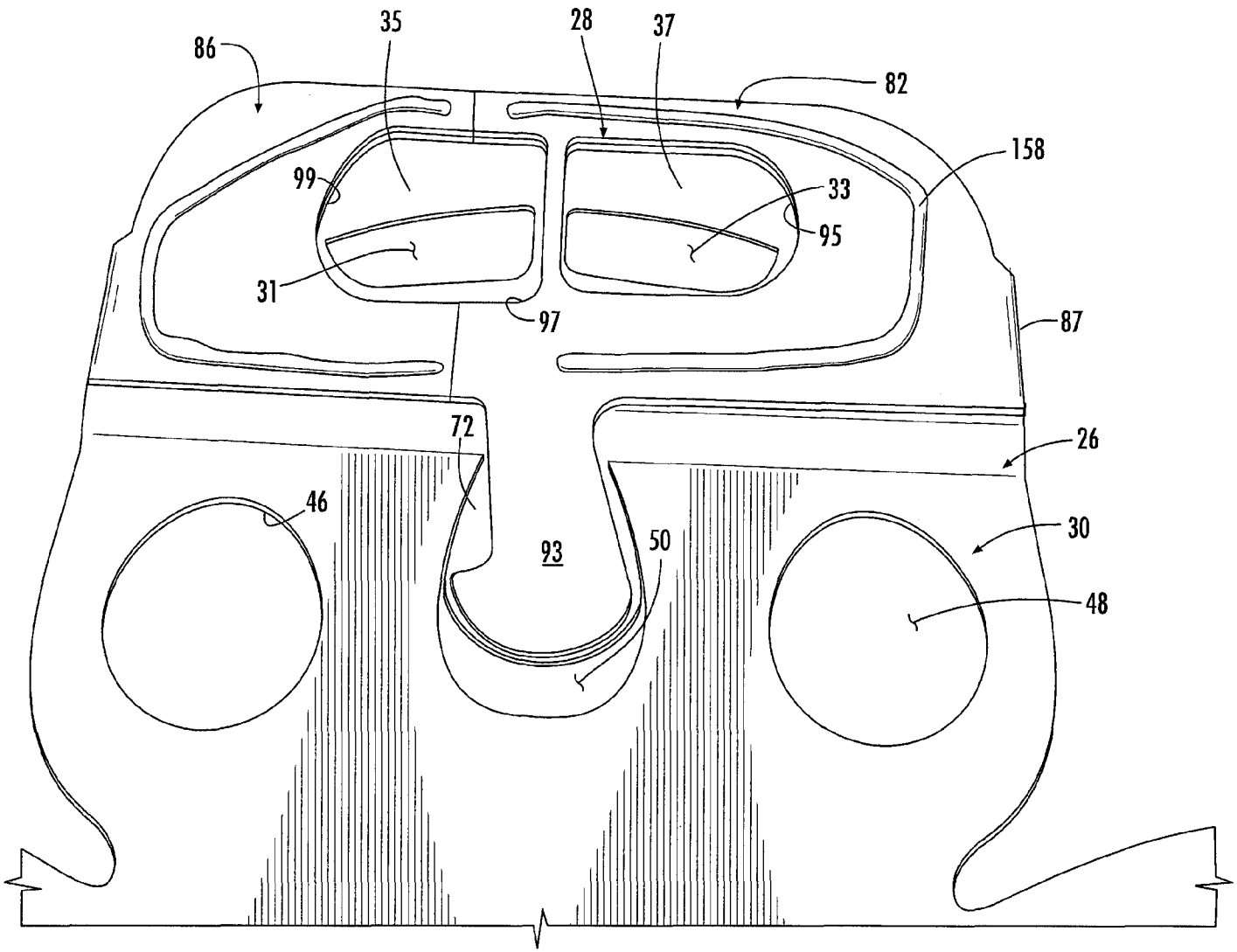
FIG. 3 is a plan view of a portion of the blank of FIG. 1 partially assembled into the carrier.

With reference to FIGS. 2-5, in one exemplary method of erection, the carrier 5 may be erected from the blank 3 by first folding the reinforcement flaps 82, 86 about respective fold lines 87, 89 to be in face-to-face relationship with the upper portion 28 of the second top panel 26. The interior surface of the reinforcement flaps 82, 86 can be secured to the interior surface of the top portion 28 of the second top panel 26 with adhesive (not shown) placed between the reinforcement flaps and the second top panel prior to positioning the reinforcement flaps and the second top panel in face-to-face contact as shown in FIG. 3. As shown in FIG. 3, glue 158 can be applied to the exterior surface of the inwardly-folded reinforcement flaps 82, 86 for securing the top portion 28 of the first top panel 24 to the reinforcement flaps. The retention portion 93 is in face-to-face contact with the retention flap 72 of the second top panel 26.

In one embodiment, the first side panel 10 is folded at fold line 107 to place the back panel 8 in face-to-face relationship with the front panel 6 and the second top panel 26, with inwardly-folded reinforcement flaps 82, 86, in face-to-face relationship with the first top panel 24. The adhesive 158 applied to the exterior surface of the reinforcement flaps 82, 86 can adhesively secure the upper portion 28 of the first top panel 24 to the reinforcement flaps when the reinforcement flaps and the first top panel are placed in face-to-face contact. When the upper portion 28 of the first top panel 24 is secured to the reinforcement flaps 82, 86, the retention flap 72 of the first top panel is in face-to-face contact with the retention portion 93 of the reinforcement flap 82, which has already been placed in face-to-face contact with the retention flap 72 of the second top panel 26. Therefore, the retention portion 93 is sandwiched between the two retention flaps 72 and the two combined retention flaps and intervening retention portion are adjacent a respective middle opening 50. The second side panel 12 is positioned to partially overlap the third side panel 14 and is attached to the third side panel. The blank 3 is further erected into the position shown in FIG. 2, wherein the blank comprises a sleeve 150 having an open-ended bottom 153 for inserting the containers C. In the partially assembled position of FIG. 2, the top portions 28 of the top panels 24, 26 are adhered together by attachment to the reinforcement flaps 82, 86, and the bottom portions 30 of the top panels are independently positionable relative to the top portions at fold lines 32, 34. Alternatively, the reinforcement flaps 82, 86 can be omitted and the top panels 24, 26 can be in face-to-face contact and adhered directly to each other.

Figure 4:
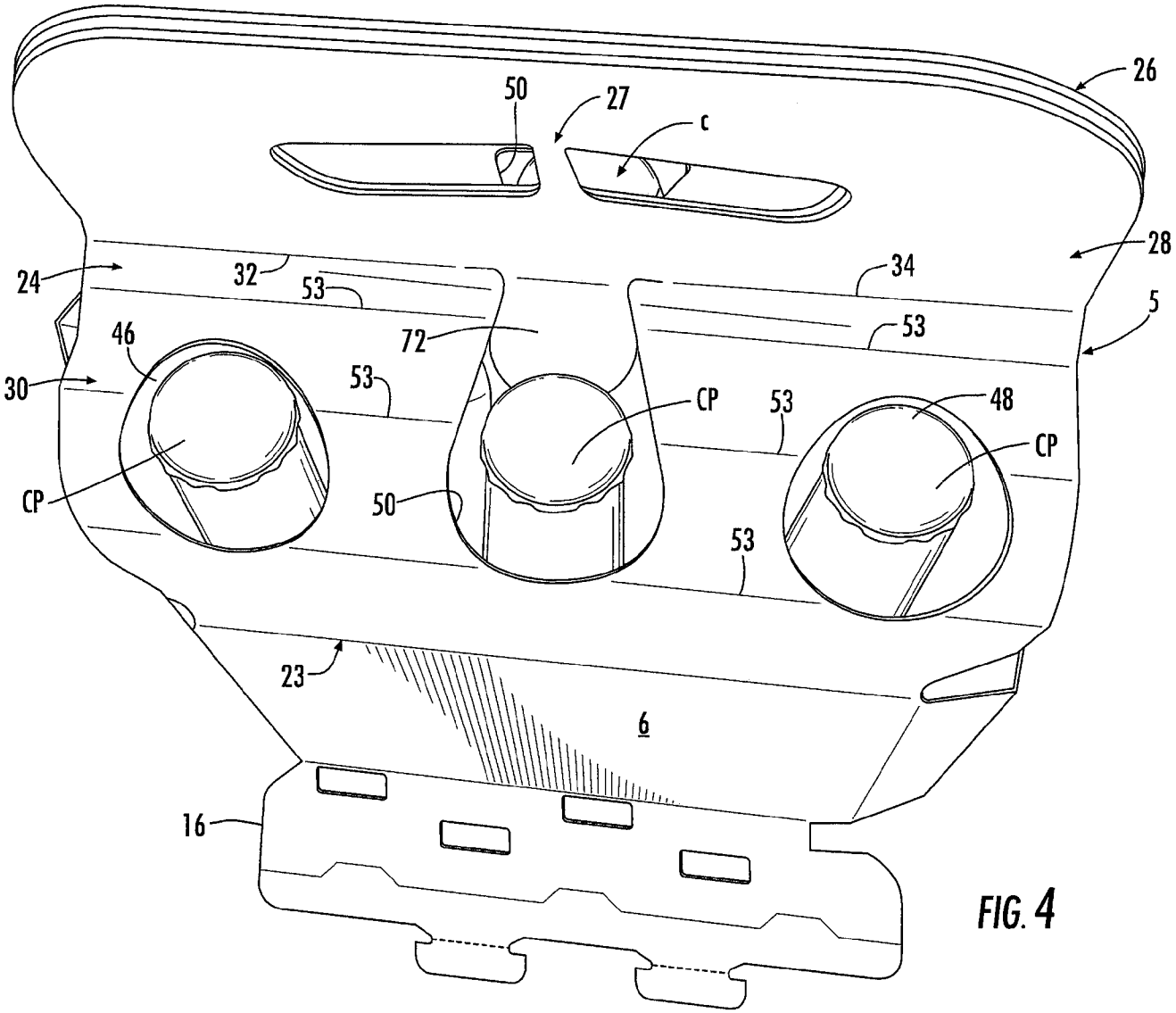
FIG. 4 is a top view of the partially assembled carrier with containers being loaded into the carrier.

Next, the containers C can be inserted through the open bottom 153 of the sleeve 150 as illustrated in FIG. 4. Alternatively, the sleeve 150 could be lowered onto a grouping of six containers C without departing from the scope of this disclosure. The caps CP of the containers are moved through the openings 46, 48, 50 in the top panels 24, 26. As the containers are placed in the sleeve 150, the bottom portions 30 of the top panels 24, 26 are folded upward at fold lines 32, 34 and are positioned to extend outward from the upper portions 28 of the top panels. As shown in FIG. 5, the upper portions 28 of the top panels 24, 26 are generally perpendicular to the bottom portions 30 of the top panels. Further, in the illustrated embodiment, the bottom portions 30 have a generally arcuate cross-sectional shape, such that the bottom portions of the top panels 24, 26 extend upward from the upper portions 28 of the top panels at fold lines 32, 34 and then downward to the fold lines 23, 25 connecting the front or back panels 6, 8. As the middle containers C are positioned in the carrier 5, the middle container of each of the front and back side of the carrier (e.g., the container C received in a respective opening 50) is positioned to contact the overlapped retention flaps 72.

Next, the first bottom flap 16 is secured to the second bottom flap 18 by first respectively engaging the primary male locking tabs 100 with the primary female locking edges 90. The secondary male locking flaps 102 are respectively inserted through, and cooperatively interact with, the slits 92 to further secure the first bottom flap 16 to the second bottom flap 18. The third bottom flap 19 is upwardly folded at fold line 21 prior to securing the first bottom flap 16 to the second bottom flap 18. The secured together bottom flaps 16, 18 and the third bottom flap 19 cooperate to form a bottom panel 160 of the carrier 5. Alternatively, the carrier 5 could have other bottom closure flap arrangements.

Figure 8:
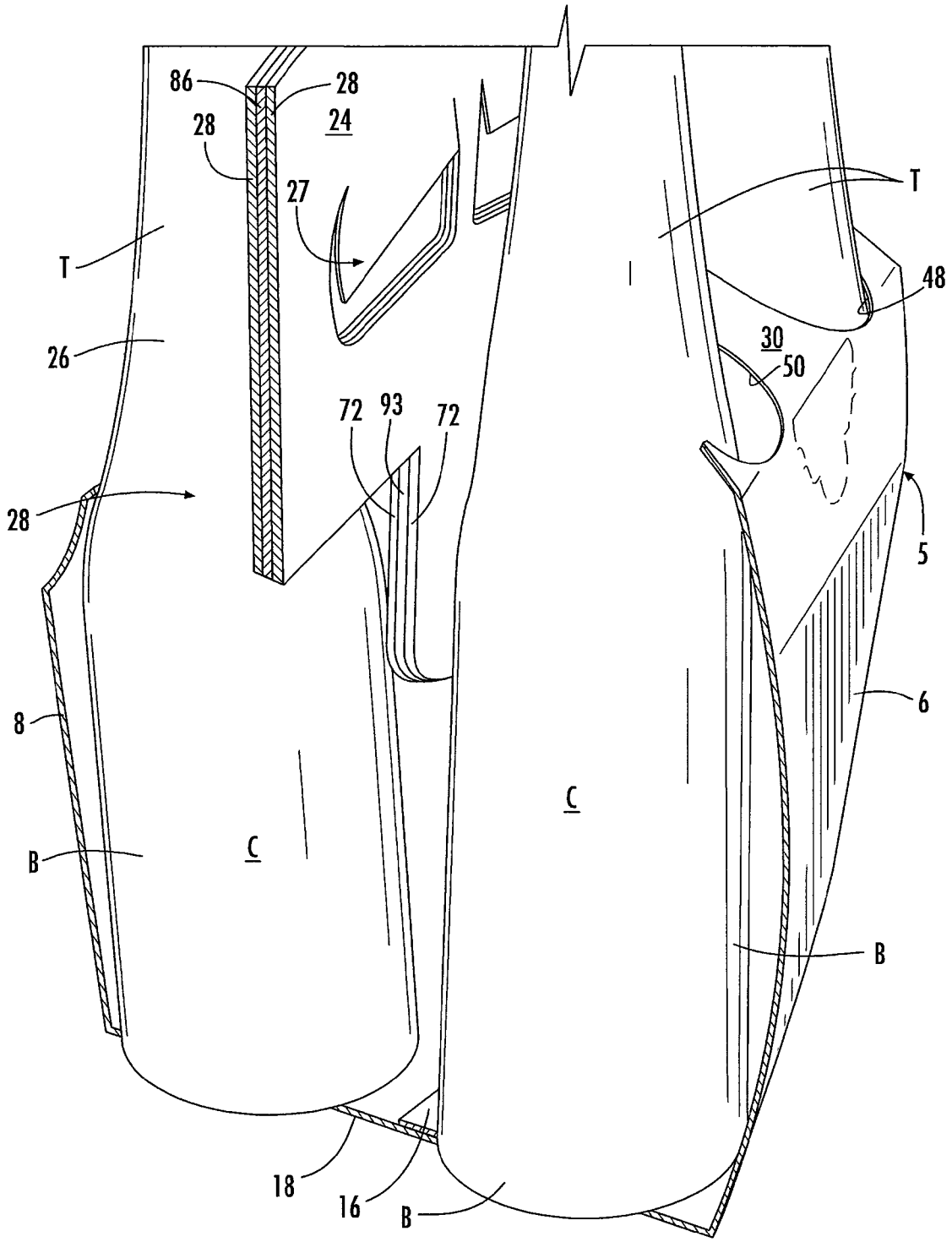
FIG. 8 is a cross-section of the carrier showing a retention flap disposed between containers.
Figure 9:
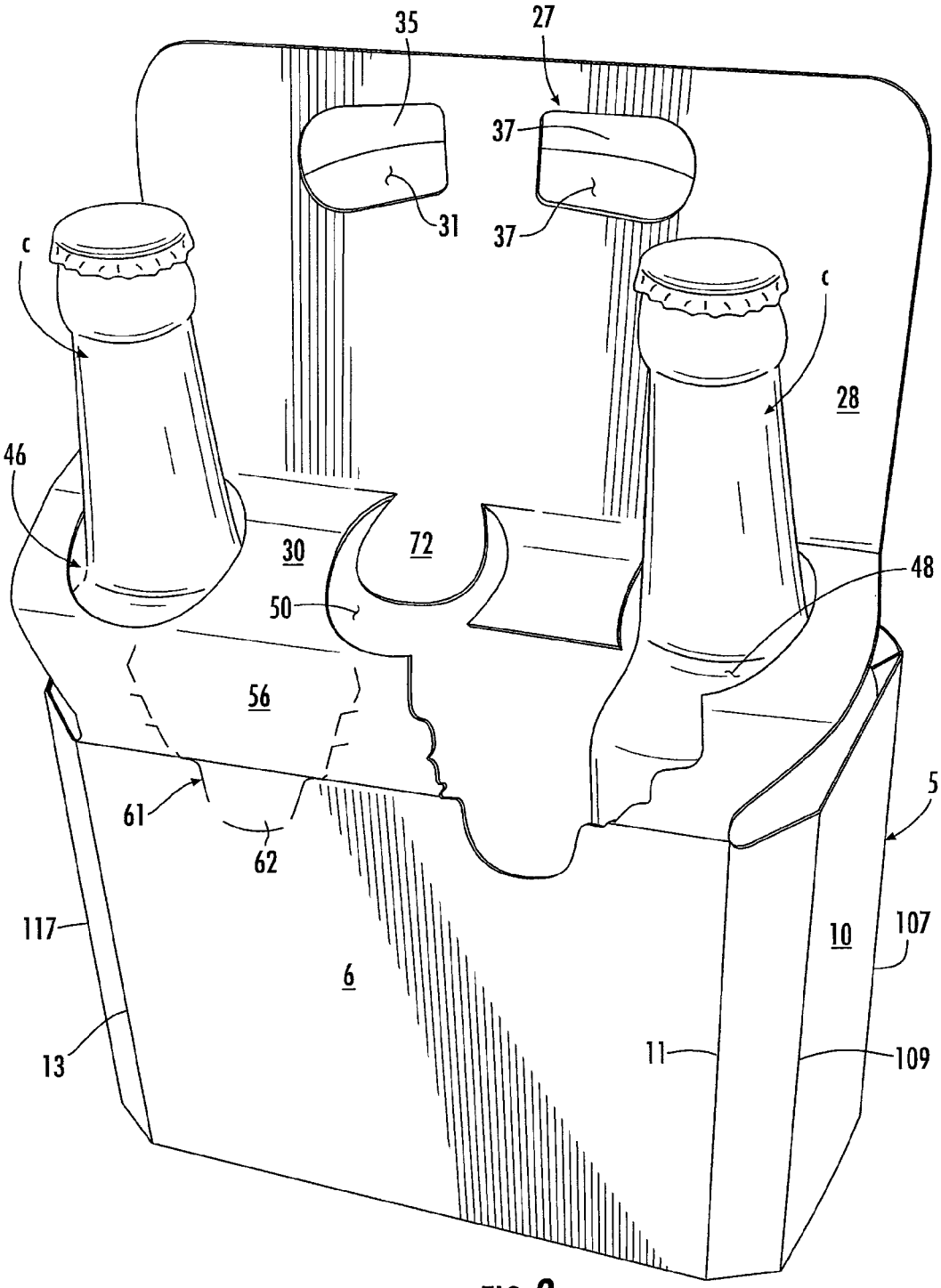
FIG. 9 is a perspective of the carrier with a middle container

FIG. 8 is a cross-sectional view of the carrier 5 with a portion of the carrier cut-away to show the two retention flaps 72 positioned between the middle containers C and in contact with a respective middle container at a front and back side of the carrier. As shown in FIG. 8, when the containers C are loaded into the carrier 5, the wide bottoms B of each of the two middle containers C contact a respective retention flap 72 which is connected to respective upper portions 28 of the top panels 24, 26. The middle containers C apply a contact/compression force to hold the retention flaps 72 in the position shown in FIG. 8. The compression force applied by the two middle containers C keeps the retention flaps 72 in the lowered position with the handle 27 in the lowered position as shown in FIGS. 5 and 8. If one of the two middle containers C are removed, the compression force is eliminated and the retention flaps 72 (and the upper portion 28 of the top panels 24, 26) are released and are free to raise upward from the lowered or loaded position shown in FIGS. 5 and 8 to the raised position generally shown in FIG. 9. The containers C and features (e.g., retention flaps 72, retention portion 93, handle 27, etc.) of the carrier 5 may be otherwise positioned, shaped, and/or arranged without departing from this disclosure.

Figure 7:
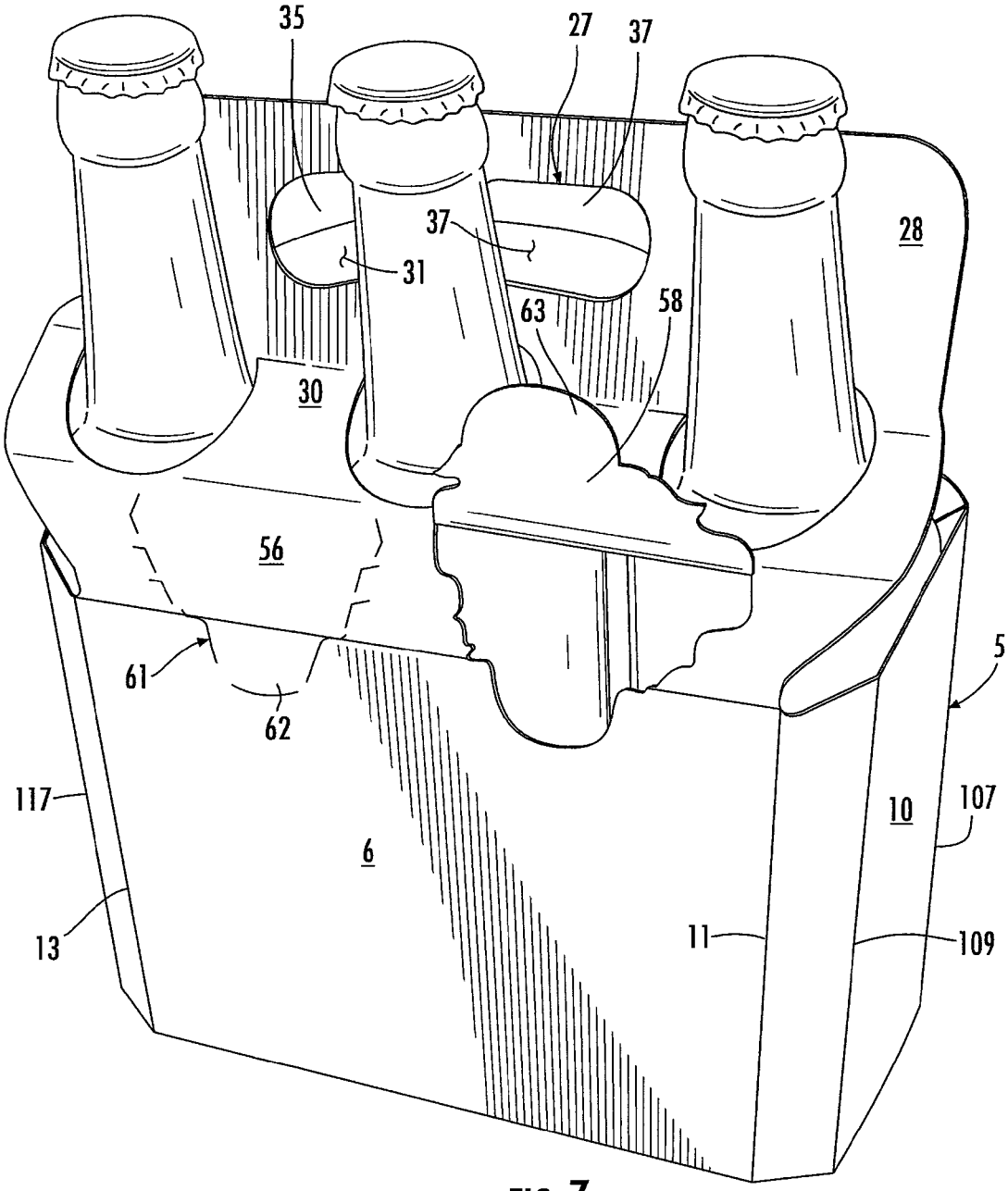
FIG. 7 is a perspective of the carrier with a dispenser panel partially removed.

The carrier 5 may be carried at openings 31, 33 of the handle 27 by pushing the handle flaps 35, 37 from either side of the carrier and grasping the top portion 28 of the top panels 24, 26. As shown in FIG. 7, containers C can be removed from the carrier by removing the dispenser panels 56, 58. The dispenser panels 56, 58 can be removed by grasping a respective actuating tab 62, 63 and tearing the dispenser panel at a respective tear line 61, 63. Once a dispenser panel 56, 58 is removed, a container C can be removed from the carrier 5. As noted above, if a middle container C is removed from the carrier 5, the holding force acting on the retention flaps 72 will be eliminated, causing the upper portion 28 of the top panels 24, 26 with the handle 27 to be released and moved to the raised position of FIG. 9. The containers C can be removed from the carrier by other tearing or dispensing features without departing from the disclosure.

The exemplary carrier embodiment discussed above accommodates six containers C arranged in two rows, but the present disclosure is not limited to these numbers. As one example, additional containers may be accommodated by increasing the size of the blank 3 (e.g., in the longitudinal direction L1 in FIG. 1) and forming additional container-receiving spaces therein. Also, the blank 3 could have less than six container-receiving spaces without departing from the disclosure. Further, the retention flaps 72 could be otherwise positioned (e.g., adjacent opening 46 and/or 48) without departing from the disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

panels that extend at least partially around an interior of the carrier, the panels comprise a front panel, a back panel, a first side panel foldably connected to at least one of the front panel and the back panel, a second side panel foldably connected to at least one of the front panel and the back panel, a first top panel foldably connected to the front panel, a second top panel foldably connected to the back panel, and at least one bottom panel;

each of the first top panel and the second top panel comprises a handle portion for forming a handle of the carrier and a retaining portion having container receiving openings for receiving the containers in the carrier, wherein each of the handle portions is foldably connected to the respective retaining portion along a respective fold line, the handle portion of the first top panel overlaps the handle portion of the second top panel, and the fold line of the first top panel is adjacent the fold line of the second top panel, each of the first top panel and the second top panel comprises a retention flap foldably connected to the respective handle portion at the respective fold line and configured to be positioned between at least two of the containers for retaining the carrier in an assembled position, wherein, for each of the first top panel and the second top panel, the retention flap extends downwardly from the handle portion and is generally coplanar with the handle portion; and at least one reinforcement flap foldably connected to the second top panel and in face-to-face contact with at least a portion of the first top panel and at least a portion of the second top panel, the at least one reinforcement flap comprising a retention portion in face-to-face contact with each of the retention flap of the first top panel and the retention flap of the second top panel.

2. The carrier of claim 1 wherein, for each of the first top panel and the second top panel, the handle portion is an upper portion and the retaining portion is a lower portion.

3. The carrier of claim 1 wherein the retention flap of each of the first top panel and the second top panel cooperate to retain the carrier in the assembled position.

4. The carrier of claim 3 wherein the at least one reinforcement flap comprises a first reinforcement flap and a second reinforcement flap, the first reinforcement flap comprising the retention portion.

5. The carrier of claim 3 wherein the retention flap of each of the first top panel and the second top panel is adjacent to a respective container receiving opening in the first and second top panel.

6. The carrier of claim 1 further comprising a dispenser comprising a dispenser panel that is at least partially separable from the carrier at a tear line, the dispenser allowing removal of at least one of the containers through a dispenser opening at least partially defined by the tear line.

7. The carrier of claim 6 wherein the dispenser panel comprises a portion of at least one of the first top panel and the second top panel.

8. The carrier of claim 7 wherein the dispenser panel comprises at least a portion of at least one of the front panel and the back panel.

9. The carrier of claim 1 wherein in the assembled position, the handle portions of the first top panel and the second top panel are configured to be retained in a lowered position between the containers.

10. The carrier of claim 1 wherein the at least one bottom panel comprises a first bottom flap foldably connected to the front panel and a second bottom flap foldably connected to the back panel, the first and second bottom flap being in interlocking engagement to form the bottom panel.

11. A blank for forming a carrier for holding a plurality of containers, the blank comprising:

panels that comprise a front panel, a back panel, a first side panel foldably connected to at least one of the front panel and the back panel, a second side panel foldably connected to at least one of the front panel and the back panel, a first top panel foldably connected to the front panel, a second top panel foldably connected to the back panel, and at least one bottom panel;

each of the first top panel and the second top panel comprises a handle portion for forming a handle of the carrier formed from the blank and a retaining portion having container receiving openings, wherein each of the handle portions is foldably connected to the respective retaining portion along a respective fold line, the handle portion of the first top panel is for overlapping the handle portion of the second top panel when the carrier is formed from the blank, and the fold line of the first top panel is for being disposed adjacent the fold line of the second top panel when the carrier is formed from the blank, each of the first top panel and the second top panel comprises a retention flap foldably connected to the handle portion at the respective fold line and adjacent one of the container receiving openings, wherein, for each of the first top panel and the second top panel, the retention flap extends downwardly from the handle portion and is generally coplanar with the handle portion when the carrier is formed from the blank; and at least one reinforcement flap foldably connected to the second top panel, the at least one reinforcement flap for being disposed in face-to-face contact with at least a portion of the first top panel and at least a portion of the second top panel when the carrier is formed from the blank, the at least one reinforcement flap comprising a retention portion for being disposed in face-to-face contact with each of the retention flap of the first top panel and the retention flap of the second top panel when the carrier is formed from the blank.

12. The blank of claim 11 wherein, for each of the first top panel and the second top panel, the handle portion is an upper portion and the retaining portion is a lower portion.

13. The blank of claim 11 wherein the retention flap of each of the first top panel and the second top panel cooperate to retain the carrier in the assembled position.

14. The blank of claim 13 wherein the at least one reinforcement flap comprises a first reinforcement flap and a second reinforcement flap, and the first reinforcement flap comprises the retention portion.

15. The blank of claim 11 further comprising a dispenser panel that is at least partially separable from the carrier at a tear line, the dispenser panel comprises a portion of at least one of the first top panel and the second top panel.

16. The blank of claim 15 wherein the dispenser panel comprises at least a portion of at least one of the front panel and the back panel.

17. The blank of claim 11 wherein the at least one bottom panel comprises a first bottom flap foldably connected to the front panel and a second bottom flap foldably connected to the back panel, the first and second bottom flap having features for being interlockingly engaged when the blank is formed into the carrier.

18. A method of forming a carrier for containing a plurality of containers, the method comprising:

obtaining a blank having panels that comprise a front panel, a back panel, a first side panel foldably connected to at least one of the front panel and the back panel, a second side panel foldably connected to at least one of the front panel and the back panel, a first top panel foldably connected to the front panel, a second top panel foldably connected to the back panel, at least one bottom panel, and at least one reinforcement flap foldably connected to the second top panel, the at lest one reinforcement flap comprising a retention portion, each of the first top panel and the second top panel comprises handle portion, a retaining portion foldably connected to the handle portion along a fold line and having container receiving openings, and a retention flap foldably connected to the handle portion at the fold line and adjacent one of the container receiving openings;

forming the blank into an open-ended sleeve with the handle portion of the first top panel overlapping the handle portion of the second top panel and the fold line of the first top panel adjacent the fold line of the second top panel such that, for each of the first top panel and the second top panel, the retention flap extends downwardly from the handle portion and is generally coplanar with the handle portion, the forming the blank into the open-ended sleeve comprising positioning the at least one reinforcement flap in face-to-face contact with at least a portion of the first top panel and at least a portion of the second top panel and positioning the retention portion of the at least one reinforcement flap in face-to-face contact with each of the retention flap of the first top panel and the retention flap of the second top panel;

inserting containers into the sleeve such that the containers are inserted through the container receiving openings of the retaining portion, at least two of the containers being placed into contact with the retention flaps of the first top panel and the second top panel to retain the carrier in an assembled position; and closing the open-ended sleeve to at least partially close the carrier.

19. The method of claim 18 wherein the at least two containers comprises at least a first container and a second container, and the inserting the containers comprises inserting the first container through a first container receiving opening in the retaining portion of the first top panel so that the first container contacts the retention flap of the first top panel and inserting the second container through a second container receiving opening in the retaining portion of the second top panel so that the second container contacts the retention flap of the second top panel.

20. The method of claim 19 wherein the first container and the second container cooperate to apply a compressive force on the adjacent retention flaps of the first top panel and the second top panel that retains the carrier in the assembled position.

21. The method of claim 18 wherein the at least one reinforcement flap comprises a first reinforcement flap and a second reinforcement flap, and the first reinforcement flap comprises the retention portion.

22. The carrier of claim 1, wherein, for each of the first top panel and the second top panel, the container receiving openings comprise a middle opening and at least one end opening in the retaining portion, the middle opening being at least partially defined by the retention flap and comprising an edge that is collinear with at least a portion of the fold line of the respective first top panel and second top panel, and the at least one end opening being spaced apart from the respective fold line.

23. The carrier of claim 1, further comprising a dispenser comprising a dispenser panel that is at least partially separable from the carrier at a tear line, wherein, for each of the first top panel and the second top panel, the container receiving openings comprise at least a first container receiving opening and a second container receiving opening, at least a portion of the dispenser panel extending between the first container receiving opening and the second container receiving opening.

24. The carrier of claim 23, wherein the tear line comprises a first end extending from the first container receiving opening and a second end extending from the second container receiving opening in each of the first top panel and the second top panel.

25. The blank of claim 11, wherein, for each of the first top panel and the second top panel, the container receiving openings comprise a middle opening and at least one end opening in the retaining portion, the middle opening being at least partially defined by the retention flap and comprising an edge that is collinear with at least a portion of the fold line of the respective first top panel and second top panel, and the at least one end opening being spaced apart from the respective fold line.

26. The blank of claim 11, further comprising a dispenser comprising a dispenser panel that is at least partially separable from the carrier at a tear line, wherein, for each of the first top panel and the second top panel, the container receiving openings comprise at least a first container receiving opening and a second container receiving opening, at least a portion of the dispenser panel extending between the first container receiving opening and the second container receiving opening.

27. The blank of claim 26, wherein the tear line comprises a first end extending from the first container receiving opening and a second end extending from the second container receiving opening in each of the first top panel and the second top panel.

28. The method of claim 18, wherein, for each of the first top panel and the second top panel, the container receiving openings comprise a middle opening and at least one end opening in the retaining portion, the middle opening being at least partially defined by the retention flap and comprising an edge that is collinear with at least a portion of the fold line of the respective first top panel and second top panel, and the at least one end opening being spaced apart from the respective fold line.

29. The method of claim 18, further comprising a dispenser comprising a dispenser panel that is at least partially separable from the carrier at a tear line, wherein, for each of the first top panel and the second top panel, the container receiving openings comprise at least a first container receiving opening and a second container receiving opening, at least a portion of the dispenser panel extending between the first container receiving opening and the second container receiving opening.

30. The method of claim 29, wherein the tear line comprises a first end extending from the first container receiving opening and a second end extending from the second container receiving opening in each of the first top panel and the second top panel.

* * * * *